US009798286B2

(12) United States Patent
Konishi

(10) Patent No.: US 9,798,286 B2
(45) Date of Patent: Oct. 24, 2017

(54) IMAGE FORMING APPARATUS

(71) Applicant: KYOCERA Document Solutions Inc., Osaka (JP)

(72) Inventor: Hirohito Konishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 43 days.

(21) Appl. No.: 15/206,691

(22) Filed: Jul. 11, 2016

(65) Prior Publication Data

US 2017/0031298 A1 Feb. 2, 2017

(30) Foreign Application Priority Data

Jul. 27, 2015 (JP) ..... 2015-147938

(51) Int. Cl.
*G03G 21/16* (2006.01)
*G03G 15/00* (2006.01)

(52) U.S. Cl.
CPC ..... *G03G 21/1642* (2013.01); *G03G 15/75* (2013.01)

(58) Field of Classification Search
None
See application file for complete search history.

(56) References Cited

U.S. PATENT DOCUMENTS 5,860,043 A * 1/1999 Ahn ..... G03G 15/167 399/111
6,240,266 B1 * 5/2001 Watanabe ..... F16D 1/101 399/117
2006/0067734 A1 * 3/2006 Igarashi ..... G03G 15/0178 399/119
2011/0188885 A1 8/2011 Fukunaga ..... 399/110

FOREIGN PATENT DOCUMENTS

JP 2001-154483 A 6/2001
JP 2008-197588 A 8/2008
JP 2011-158624 A 8/2011

* cited by examiner

*Primary Examiner* — Thomas Giampaolo, II
(74) *Attorney, Agent, or Firm* — Stein IP, LLC

(57) ABSTRACT

An image forming apparatus includes an image carrying member unit having an image carrying member, a developing unit insertable into and drawable out of the image forming apparatus, and a transfer member. The image carrying member unit is movable between a first position where the image carrying member makes contact with the transfer member and a second position where they are apart. The image carrying member unit or the image forming apparatus has a biasing member that biases the image carrying member unit toward the second position. With the developing unit fitted to the image forming apparatus, the image carrying member unit is at the first position against a biasing force of the biasing member. With the developing unit drawn out of the image forming apparatus, the image carrying member unit is at the second position due to the biasing force of the biasing member.

7 Claims, 6 Drawing Sheets

IMAGE FORMING APPARATUS

INCORPORATION BY REFERENCE

This application is based upon and claims the benefit of priority from the corresponding Japanese Patent Application No. 2015-147938 filed on Jul. 27, 2015, the entire contents of which are incorporated herein by reference.

BACKGROUND

The present disclosure relates to an image forming apparatus, such as a copier, a printer, or a facsimile machine, that is provided with an image carrying member and a transfer member which transfers a toner image formed on the image carrying member to a recording medium.

Commonly, in conventional image forming apparatuses adopting an electrophotographic process, an electrostatic latent image is formed on an image carrying member such as a photosensitive drum the surface of which has been electrostatically charged uniformly, and by use of a developing unit, a toner image is formed based on the electrostatic latent image on the image carrying member. Then, by use of a transfer member such as a transfer roller that forms a transfer nip portion with the image carrying member, the toner image formed on the image carrying member is transferred to a sheet which is transported, and then the sheet is passed through a fixing unit, where the toner image is fixed on the sheet.

A configuration is known in which a developing unit is removable from the main body of an image forming apparatus. When a jam occurs inside the image forming apparatus, it is possible to remove the developing unit to take out a jammed sheet.

On the other hand, an image forming apparatus is known that is provided with a transfer roller release lever which opens a nip between a photosensitive drum and a transfer roller. When handling a jam, it is possible to open the nip between the photosensitive drum and the transfer roller by operating the transfer roller release lever, and thus to easily remove a sheet stuck in the nip.

SUMMARY

According to one aspect of the present disclosure, an image forming apparatus includes an image carrying member unit, a developing unit, and a transfer member. The image carrying member unit has an image carrying member on which an electrostatic latent image is formed. The developing unit can be inserted into and drawn out of the image forming apparatus, and develops the electrostatic latent image on the image carrying member into a toner image. The transfer member transfers, while being in contact with the image carrying member, the toner image formed on the image carrying member to a recording medium. The image carrying member unit is arranged movably between a first position where the image carrying member and the transfer member are in contact with each other and a second position where the image carrying member and the transfer member are apart from each other. The image carrying member unit or the image forming apparatus is provided with a biasing member that biases the image carrying member unit in the direction of the second position. When the developing unit is fitted to the image forming apparatus, the image carrying member unit is located at the first position against a biasing force of the biasing member, and when the developing unit is drawn out of the image forming apparatus, the image carrying member unit is located at the second position due to the biasing force of the biasing member.

Further features and advantages of the present disclosure will become apparent from the description of embodiments given below.

DETAILED DESCRIPTION

Figure 1:
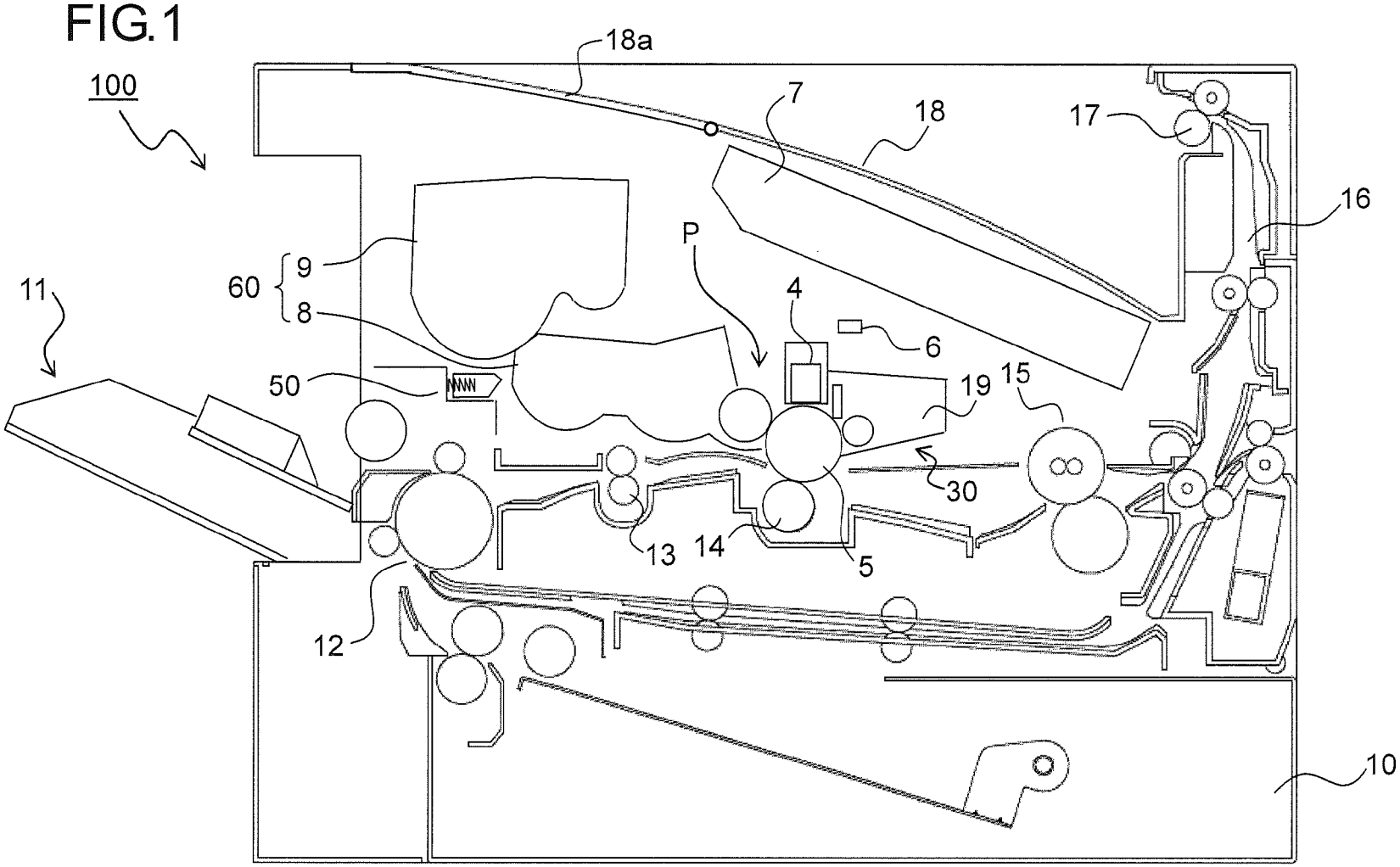
FIG. 1 is a side sectional view showing an internal structure of an image forming apparatus according to one embodiment of the present disclosure.

Hereinafter, embodiments of the present disclosure will be described with reference to the accompanying drawings. FIG. 1 is a side sectional view showing an internal structure of an image forming apparatus 100 according to one embodiment of the present disclosure. In the image forming apparatus (here, a monochrome printer) 100, there is arranged an image forming section P that forms a monochrome image through the processes of electrostatic charging, exposure to light, image development, and image transfer. In the image forming section P, there are arranged, along the rotation direction (the clockwise direction in FIG. 1) of a photosensitive drum 5, a charging device 4, an exposure unit (such as a laser scanning unit) 7, a developing device 8, a transfer roller 14, a cleaning device 19, and a destaticizer 6.

When image formation is performed, the photosensitive drum 5 rotating in the clockwise direction is electrostatically charged uniformly by the charging device 4. Then, an electrostatic latent image is formed on the photosensitive drum 5 by a laser beam from the exposure unit 7 based on document image data. Then, developer (hereinafter referred to as toner) is attached to the electrostatic latent image by the developing device 8, thereby forming a toner image.

The toner is fed to the developing device 8 from a toner container 9. The image data is transmitted from a personal computer (unillustrated) or the like. The destaticizer 6 that removes electric charge remaining on the surface of the photosensitive drum 5 is arranged on the downstream side of the cleaning device 19 with respect to the rotation direction of the photosensitive drum 5.

The charging device 4, the photosensitive drum 5, and the cleaning device 19 are integrated into a unit; the developing device 8 and the toner container 9 are integrated into a unit. The unit composed of the charging device 4, the photosensitive drum 5, and the cleaning device 19 is hereinafter referred to as a drum unit 30. The unit composed of the developing device 8 and the toner container 9 is hereinafter referred to as a developing unit 60. The drum unit 30 and the developing unit 60 are removable from the main body of the image forming apparatus 100.

Toward the photosensitive drum 5 having the toner image formed on it as described above, a sheet is transported from a sheet feed cassette 10 or a manual sheet feed device 11 via a sheet transport passage 12 and a registration roller pair 13. Then, the toner image formed on the surface of the photosensitive drum 5 is transferred to the sheet by the transfer roller 14. The sheet having the toner image transferred thereto is separated from the photosensitive drum 5, and is transported to a fixing device 15, where the toner image is fixed. The sheet having passed through the fixing device 15 is transported through a sheet transport passage 16 to an upper part of the apparatus, and is discharged via a discharge roller pair 17 onto a discharge tray 18.

On the top surface of the image forming apparatus 100, there is arranged an opening/closing cover 18*a* that constitutes a part of the discharge tray 18. A lock mechanism 50 that holds the developing unit 60 at a predetermined position inside the main body of the image forming apparatus 100 is arranged next to the developing unit 60 on the upstream side of the developing unit 60 with respect to its inserting direction. The structure of the lock mechanism 50 will be described in detail later.

Figure 2:
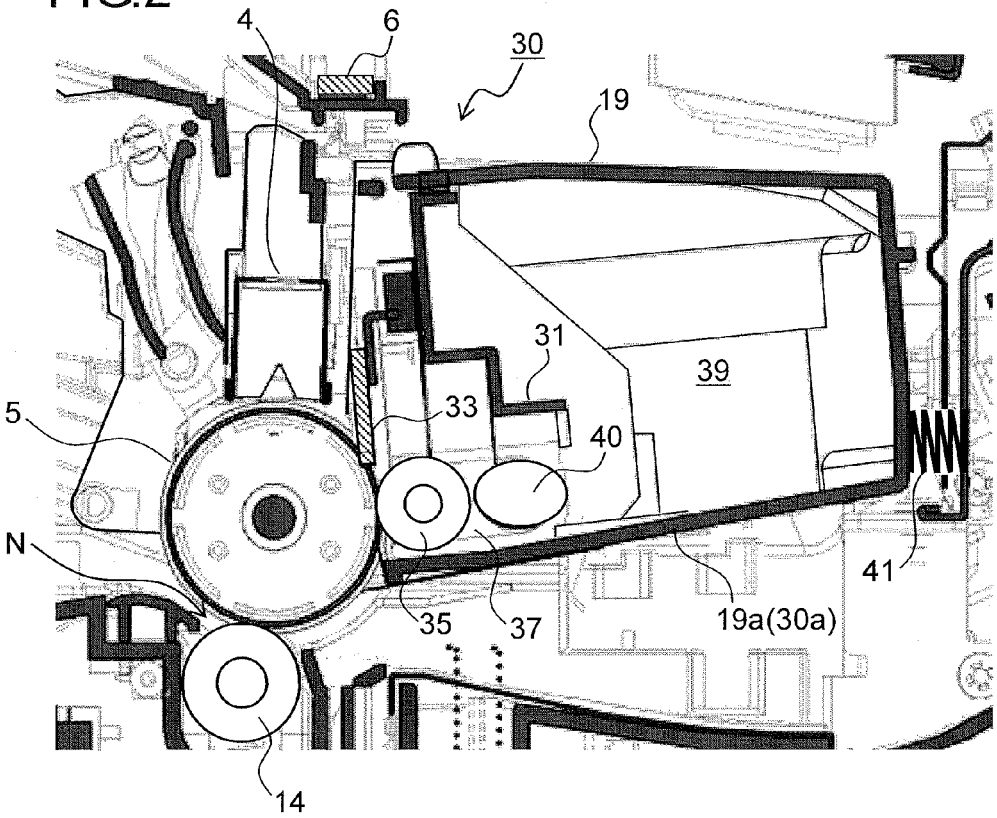
FIG. 2 is a partly enlarged view of the drum unit and a periphery thereof in FIG. 1.

FIG. 2 is a partly enlarged view of and around the drum unit 30 in FIG. 1. The drum unit 30 has a unit housing 30*a* integrally holding the photosensitive drum 5, the charging device 4, and the cleaning device 19. The cleaning device 19 has a housing 19*a*, which has an opening at the photosensitive drum 5-side and constitutes a part of the unit housing 30*a*. The interior of the housing 19*a* is divided into two parts by a partition wall 31. On the photosensitive drum 5 side of the partition wall 31, a toner scraping portion 37 is arranged in which a cleaning blade 33 and a cleaning roller 35 are arranged.

On the opposite side of the partition wall 31 from the toner scraping portion 37, a waste toner storage 39 is arranged in which the waste toner scraped off the photosensitive drum 5 by the cleaning blade 33 and the cleaning roller 35 is stored. The toner scraping portion 37 and the waste toner storage 39 communicate with each other under the partition wall 31, and a sweep roller 40 is provided for feeding the waste toner in the toner scraping portion 37 into a communication portion.

Figure 3:
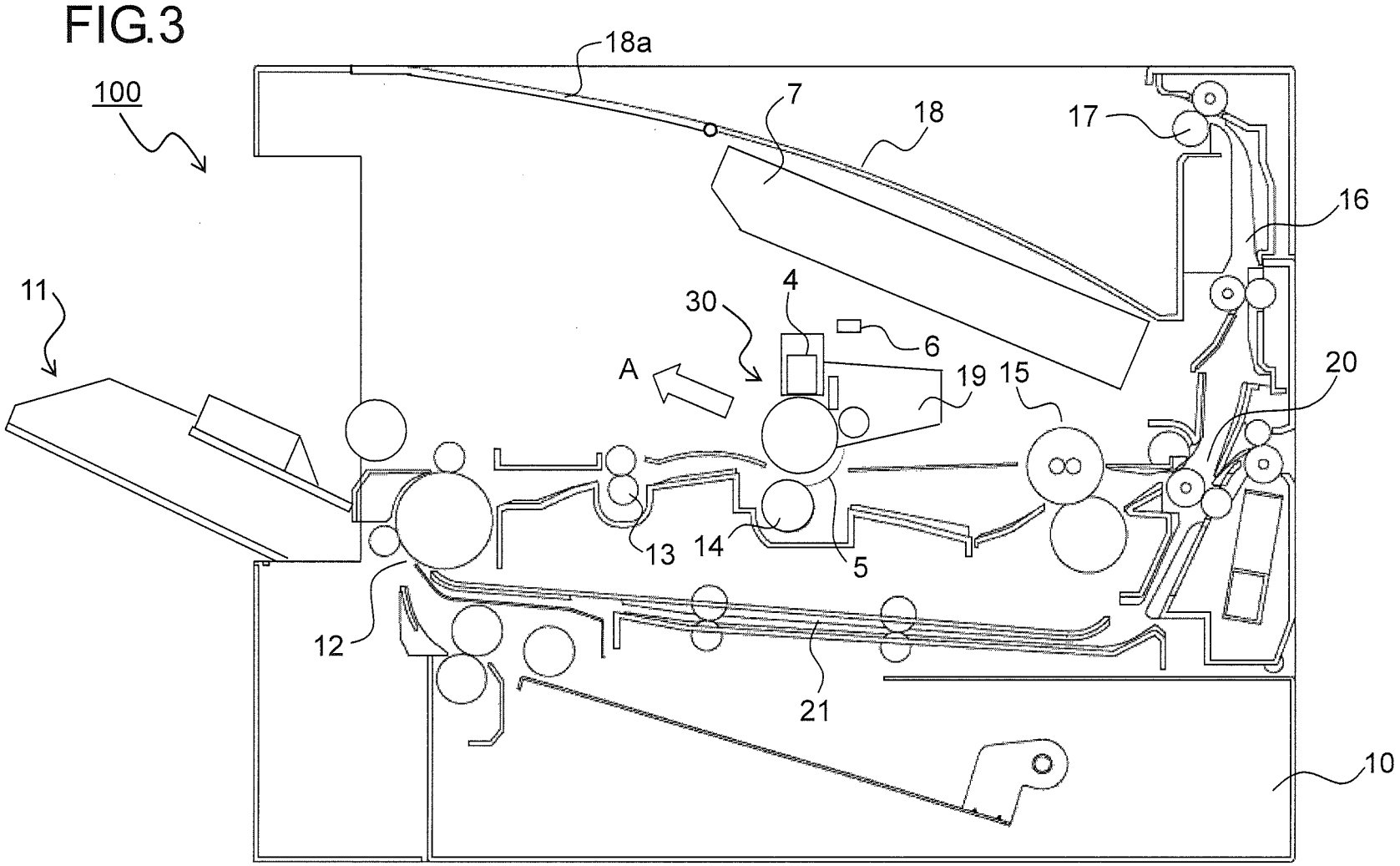
FIG. 3 is a side sectional view of the image forming apparatus with a developing unit removed.

The charging device 4 is arranged over the entire length of the photosensitive drum 5 in its longitudinal direction (the direction perpendicular to the plane of FIG. 3). The charging device 4 includes a shield member (housing) with a U-shaped section which has an opening toward the surface of the photosensitive drum 5, a corona wire to which a high voltage is applied, and a grid arranged in the opening of the shield member (none of these is illustrated). The charging device 4 electrostatically charges the surface of the photosensitive drum 5 with a predetermined positive potential (the same polarity as toner) via the gird by corona discharge from the corona wire.

Between a side surface of the unit housing 30*a* on the opposite side from the photosensitive drum 5 (on the right side in FIG. 2) and the main body of the image forming apparatus 100, a first coil spring 41 is arranged. The drum unit 30 is biased in the direction of the photosensitive drum 5 (in the leftward direction in FIG. 2) by the first coil spring 41. The first coil spring 41 may be supported on the unit housing 30*a* side of the drum unit 30, or may be supported on the main body side of the image forming apparatus 100.

In FIG. 2, the drum unit 30 is pressed to the downstream side of the drum unit 30 with respect to its inserting direction (in the rightward direction in FIG. 2) by the developing unit 60 (see FIG. 1), and is thereby inserted, while compressing the first coil spring 41, until it reaches a predetermined position inside the main body of the image forming apparatus 100. The drum unit 30 is arranged at a position (hereinafter referred to as a first position) where a transfer nip portion N is formed as a result of the photosensitive drum 5 and the transfer roller 14 being in pressed contact with each other. The transfer roller 14 is rotatably fixed on the main body of the image forming apparatus 100.

Figure 4:
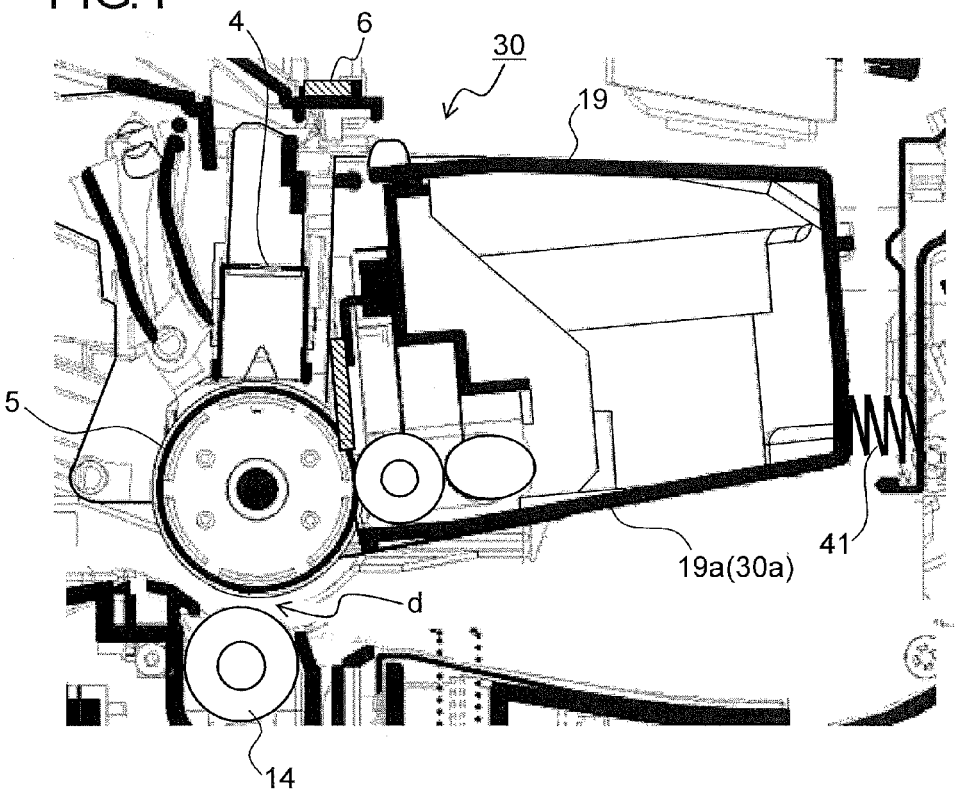
FIG. 4 is a partly enlarged view of the drum unit and a periphery thereof in the state shown in FIG. 3.
Figure 5:
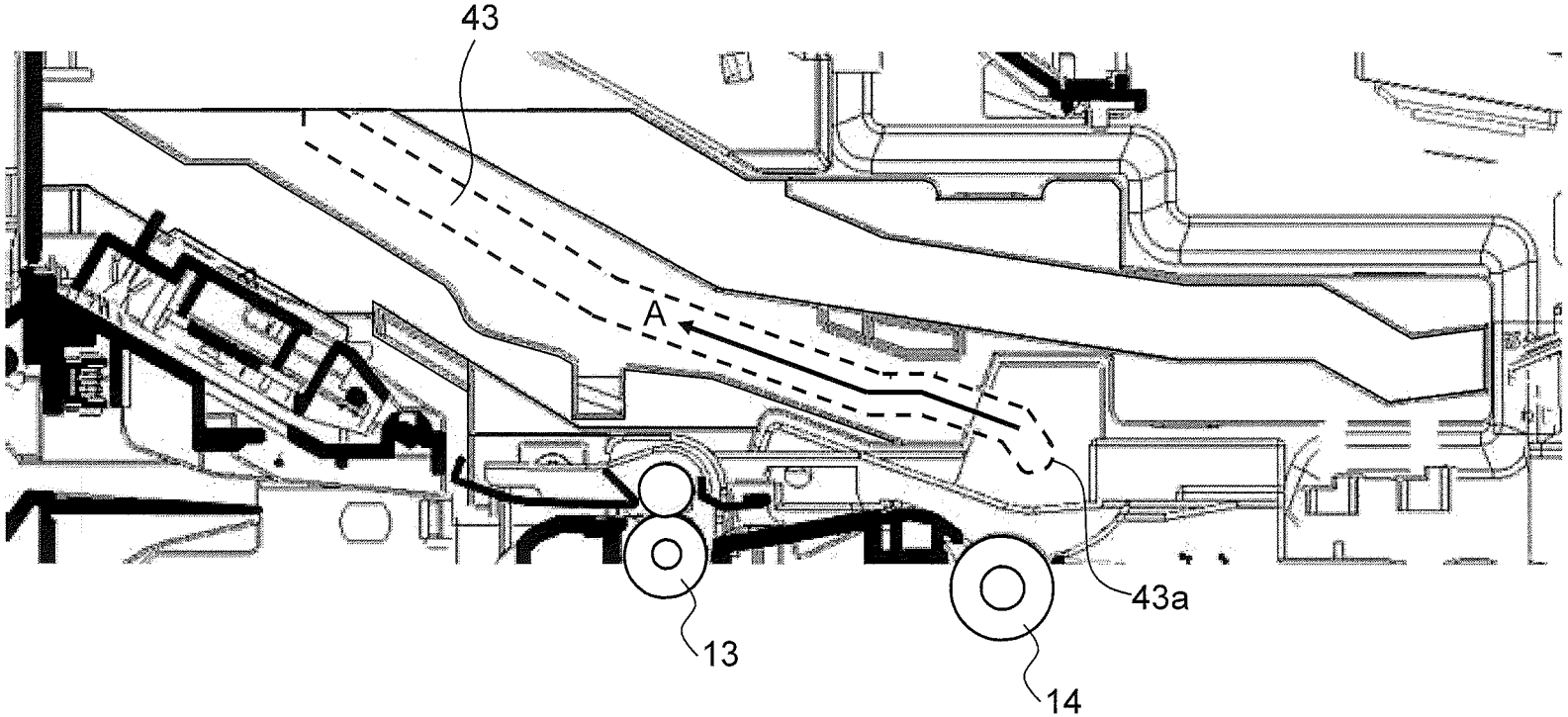
FIG. 5 is a plan view of a guide groove formed, for inserting and drawing the drum unit, inside the image forming apparatus.

FIG. 3 is a side sectional view of the image forming apparatus 100 with the developing unit 60 (the developing device 8, the toner container 9) removed. FIG. 4 is a partly enlarged view of and around the drum unit 30 in the state shown in FIG. 3. FIG. 5 is a plan view of a guide groove 43 formed, for inserting and drawing the drum unit 30, inside the image forming apparatus 100. When the drum unit 30 is inserted into or drawn out of the image forming apparatus 100, the guide groove 43 is engaged with a drum bearing 45 into which a rotary shaft 5*a* of the photosensitive drum 5 is fitted (see FIG. 6 for both). In a downstream-side end part of the guide groove 43 with respect to the inserting direction of the drum unit 30, a positioning portion 43*a* is formed. When the drum unit 30 is arranged in the first position, the rotary shaft 5*a* of the photosensitive drum 5 is arranged in the positioning portion 43*a*, and the photosensitive drum 5 makes contact with the transfer roller 14, with the result that the transfer nip portion N is formed.

When the developing unit 60 is drawn out of the main body of the image forming apparatus 100 with the opening/closing cover 18*a* (see FIG. 1) open, no pressing force from the developing unit 60 acts on the drum unit 30. Thus, the drum unit 30 moves, due to the biasing force (restoring force) of the first coil spring 41, along the guide groove 43 to the upstream side with respect to the inserting direction of the drum unit 30 (in the direction indicated by an arrow A).

As the drum unit 30 moves, the rotary shaft 5*a* (see FIG. 6) of the photosensitive drum 5 moves from the positioning portion 43*a* and deviates in a direction away from a rotary shaft 14*a* (see FIG. 6) of the transfer roller 14. As a result, the drum unit 30 is arranged at a position (hereinafter referred to as a second position) where a gap d is formed as a result of the photosensitive drum 5 and the transfer roller 14 being released out of pressed contact with each other.

Figure 6:
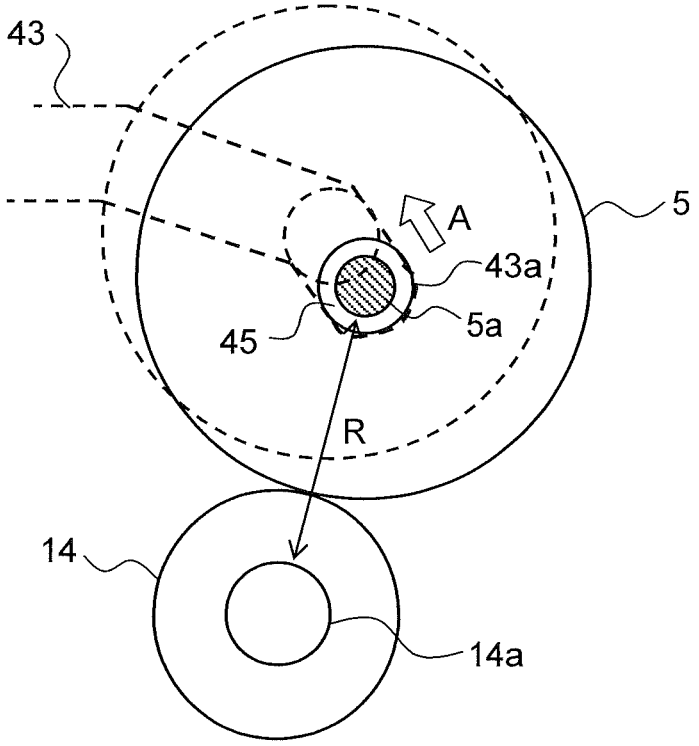
FIG. 6 is a diagram showing a relationship between rotary shafts of a photosensitive drum and a transfer roller when the drum unit moves from a first position to a second position.

FIG. 6 is a diagram showing the relationship between the rotary shafts of the photosensitive drum 5 and the transfer roller 14 when the drum unit 30 moves from the first position to the second position. As the drum unit 30 moves, due to the biasing force of the first coil spring 41 (see FIG. 4), to the upstream side with respect to the inserting direction of the drum unit 30 (in the direction indicated by the arrow A), the photosensitive drum 5 moves together to the position indicated by broken lines in FIG. 6 to be apart from the transfer roller 14. Here, the rotary shaft 5*a* of the photosensitive drum 5 moves from the positioning portion 43*a* in a direction in which the shaft-to-shaft distance R from the rotary shaft 14*a* of the transfer roller 14 increases. Thus, when the photosensitive drum 5 is moved away from the transfer roller 14, no load is received from the transfer roller 14; this permits the drum unit 30 to move smoothly from the first position to the second position without damaging the photosensitive drum 5.

On the other hand, when the developing unit 60 is inserted into the main body of the image forming apparatus 100 from the state shown in FIG. 3, a pressing force from the developing unit 60 acts on the drum unit 30. As a result, the drum unit 30 moves, against the biasing force (restoring force) of the first coil spring 41, along the guide groove 43 to the downstream side with respect to the inserting direction of the drum unit 30 (in the opposite direction to the direction indicated by the arrow A).

Figure 7:
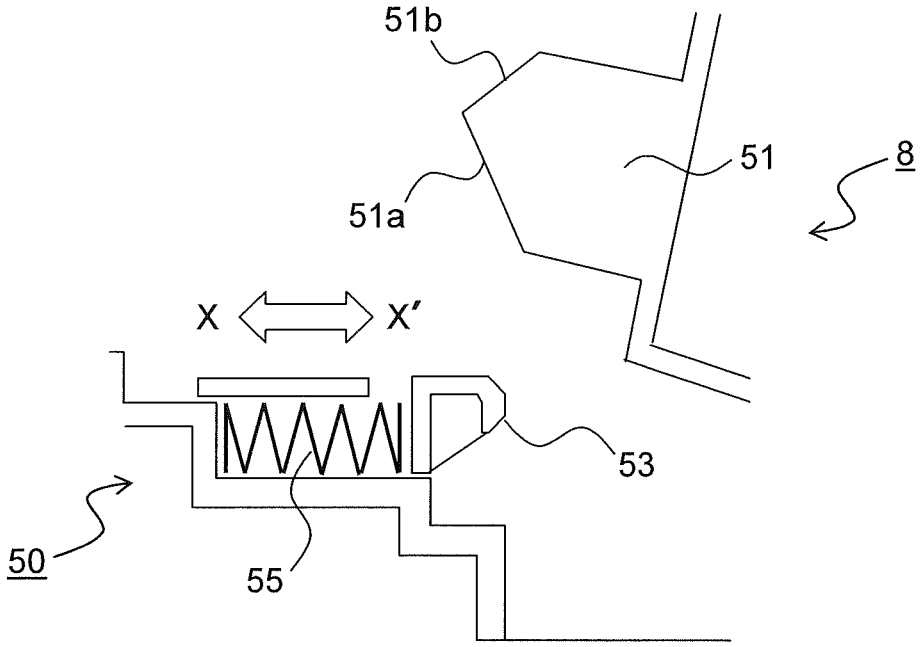
FIG. 7 is a side sectional view showing a structure of a lock mechanism of the developing unit.

FIG. 7 is a side sectional view showing a structure of the lock mechanism 50 of the developing unit 60. On the main body of the image forming apparatus 100, there is a retractably supported lock member 53 to which an engaging protrusion 51 is fitted that protrudes rearward from the developing device 8. The lock member 53 is biased in its protruding direction by a second coil spring 55. In a lower corner part of the engaging protrusion 51, a first inclined surface 51*a* is formed; in an upper corner part of the engaging protrusion 51, a second inclined surface 51*b* is formed.

When the developing unit 60 is pressed down in the downward direction, the engaging protrusion 51 approaches the lock member 53 from above, and a top end part of the lock member 53 makes contact with the first inclined surface 51*a*. Thus, a force in the direction indicated by an arrow X is applied to the lock member 53, and as a result the lock member 53 moves in the direction indicated by the arrow X against the biasing force of the second coil spring 55. When the first inclined surface 51*a* has moved past in front of the lock member 53, the lock member 53 protrudes back in the direction indicated by an arrow X' due to the biasing force of the second coil spring 55 so as to be engaged with the second inclined surface 51*b*. Thus, the developing unit 60 is pressed in the lower rightward direction in FIG. 1 and is thereby positioned at the predetermined position. Accordingly, the drum unit 30, by being pressed to the downstream side with respect to its insertion direction (in the opposite direction to the direction indicated by the arrow A) by the developing unit 60, is positioned at the first position.

With the configuration according to the present embodiment, simply by drawing the developing unit 60 out of the image forming apparatus 100, it is possible to release the photosensitive drum 5 and the transfer roller 14 out of pressed contact with each other, and thus to easily remove a sheet stuck in the transfer nip portion N. When the drum unit 30 is drawn out of the image forming apparatus 100, the photosensitive drum 5 and the transfer roller 14 do not interfere with each other, and thus the photosensitive drum 5 can be prevented from being damaged.

Compared with a configuration in which there is provided a pressure releasing member such as a lever that releases the photosensitive drum 5 and the transfer roller 14 out of pressed contact with each other, there is no need to give consideration to the strength of a pressure releasing member, and the drum unit 30 has only to be moved in the inserting/drawing direction. This allows the first coil spring 41 a larger design margin. Thus, the image forming apparatus 100 offers improved jam handling combined with improved serviceability and durability of the drum unit 30.

The embodiments described above are in no way meant to limit the present disclosure, which thus allows for many modifications and variations within the spirit of the present disclosure. For example, although in the above-described embodiment, the first coil spring 41 is arranged between the drum unit 30 and the main body of the image forming apparatus 100, in place of the first coil spring 41, any other type of biasing member such as a flat spring may be arranged.

Needless to say, the present disclosure is applicable, not only to monochrome printers like the one shown in FIG. 1, but also to other types of image forming apparatuses incorporating a drum unit 30, such as color printers, monochrome and color copiers, digital multifunction peripherals, facsimile machines, etc.

The present disclosure is applicable to image forming apparatuses incorporating an image carrying member unit. Based on the present disclosure, it is possible to provide an image forming apparatus that can move an image carrying member and a transfer member apart from each other with a simple configuration and that permits drawing of an image carrying member unit with improved ease.

What is claimed is:

1. An image forming apparatus comprising:

an image carrying member unit which has an image carrying member on which an electrostatic latent image is formed, the image carrying member unit being insertable into and drawable out of a main body of the image forming apparatus;

a developing unit which can be inserted into and drawn out of the main body of the image forming apparatus separately from the image carrying member unit and which develops the electrostatic latent image on the image carrying member into a toner image; and a transfer member which transfers, while being in contact with the image carrying member, the toner image formed on the image carrying member to a recording medium, wherein the image carrying member unit, when fitted to the main body of the image forming apparatus, is arranged movably between a first position where the image carrying member and the transfer member are in contact with each other and a second position where the image carrying member and the transfer member are apart from each other, the image carrying member unit or the main body of the image forming apparatus is provided with a biasing member that biases the image carrying member unit in a direction toward the second position, and when the developing unit is fitted to the main body of the image forming apparatus, the image carrying member unit is located at the first position against a biasing force of the biasing member by a pressing force from the developing unit, and when the developing unit is drawn out of the main body of the image forming apparatus, the pressing force from the developing unit is removed and the image carrying member unit is located at the second position due to the biasing force of the biasing member.

2. The image forming apparatus of claim 1, wherein the image carrying member unit is located at the second position by being moved from the first position in a direction in which a shaft-to-shaft distance between the image carrying member and the transfer member increases.

3. The image forming apparatus of claim 1, wherein the image carrying member unit can be inserted into and drawn out of the image forming apparatus in a same direction as the developing unit.

4. The image forming apparatus of claim 3, wherein in the image forming apparatus, a guide groove is formed that supports the image carrying member unit such that the image carrying member unit is slidable in inserting and drawing directions thereof, and in a downstream-side end part of the guide groove with respect to the inserting direction of the image carrying member unit, a positioning portion is formed that holds the image carrying member unit at the first position.

5. The image forming apparatus of claim 4, wherein the guide groove is engaged with a bearing into which a rotary shaft of the image carrying member is fitted.

6. The image forming apparatus of claim 1, wherein in the image forming apparatus, a lock mechanism is provided that holds the developing unit in a state fitted to the image forming apparatus.

7. The image forming apparatus of claim 1, wherein the developing unit is inserted into the main body of the image forming apparatus after the image carrying member unit is inserted thereinto, and the developing unit is drawn out of the main body of the image forming apparatus before the image carrying member unit is drawn out thereof.

* * * * *